US005708986A

United States Patent [19]

Belardinelli

[11] Patent Number: 5,708,986

[45] Date of Patent: Jan. 20, 1998

[54] UNDERGARMENT HAVING REAR SUPPORTS

[76] Inventor: Marie Belardinelli, 301 Boxwood Rd., Wilmington, Del. 19804

[21] Appl. No.: 691,601

[22] Filed: Aug. 2, 1996

[51] Int. Cl.[6] ..... A41B 9/04

[52] U.S. Cl. ..... 2/406; 2/400; 450/155; 450/99

[58] Field of Search ..... 2/400–402, 406, 2/227, 228, 238, 73, 71, 72–74; 450/155, 97–99

[56] References Cited

U.S. PATENT DOCUMENTS 2,980,114 4/1961 Montoya ..... 450/99

FOREIGN PATENT DOCUMENTS 56590 8/1939 Denmark ..... 450/99

220545 8/1924 United Kingdom ..... 2/73

*Primary Examiner*—Gloria Hale

*Attorney, Agent, or Firm*—Ratner & Prestia

[57] ABSTRACT

The invention is an undergarment to be worn by a person on their lower torso area. The undergarment includes an opening having a support for each buttock of the wearer. The support is adapted to support the buttock of the wearer in an upraised position.

9 Claims, 3 Drawing Sheets

UNDERGARMENT HAVING REAR SUPPORTS

BACKGROUND OF THE INVENTION

1. Field of the Invention

This invention relates to an undergarment to be worn by a person. More particularly, this invention relates to a girdle-like garment having an opening positioned at each buttock of the wearer and adapted to support the buttocks in a raised position.

2. Description of Related Art

Typically everyone likes to present their figure in the most attractive manner as possible to please themselves and/or others. However, a person's body may not naturally have the desired shape and/or proportions, or other factors such as age or illness may influence the natural shape of a person's figure. Thus, a person may emphasize certain body parts and/or de-emphasize other body parts in order to present his/her figure in an aesthetically pleasing manner. In particular, a woman may desire to accentuate certain aspects of her body, such as legs, derriere and breasts, by wearing certain garments such as stockings, girdle or brazier to improve the presentation of her figure.

Clothing can also influence how a person attractively presents their figure. A person may wear a particular clothing style in order to present a desired bodily appearance. However, clothing is designed according to the current fashions which may or may not improve the appearance of a person's figure. In fact, at times certain fashion styles of clothing do not flatter a person's particular body shape or the natural proportion of a body feature which results in poor fit of a garment and unattractive appearance for the wearer.

Designers have created garments to enhance not only the size of certain body parts, but also the presentation of these parts. A recent example which appears to be quite popular is the push-up brassiere which is designed to push the breasts together and up, resulting in an enhanced presentation of the breasts by making them look fuller and bigger than they really are.

A variety of undergarments including girdles have been used to present a person's lower torso area from the waist to below the hips including derriere and tummy, as firm and smooth. In general these undergarments have been designed to allow the derriere to appear natural without enhancing the shape of the derriere. These undergarments while firming and smoothing also tend to flatten the buttocks of the derriere. There is a desire by some persons for the buttocks of the derriere to be enhanced, that is, uplifted and shaped so as to have an attractive curvature to the buttocks. Pads have been used to enhance the derriere to make the buttocks appear fuller and rounded. However, the use of pads causes the derriere to look quite unnatural.

As such, it is an object of the invention to provide an undergarment which enhances the presentation of the derriere by uplifting and naturally shaping the derriere so as to have an attractive curvature.

It is another object of the invention to provide an undergarment which shapes the natural endowment of the person's derriere without supplements and results in a natural look.

It is still another object of the invention to provide an undergarment which enables a person to improve the appearance of their figure by shaping their derriere so as to attractively fit into stylish clothing.

These and other objects of the present invention will be clear from the following description.

SUMMARY OF THE INVENTION

The present invention is an undergarment for a person to be worn over a lower torso area including waist, crotch, hips, left buttock, and right buttock of the person, comprising:

a front portion, a rear portion and a crotch portion substantially enclosing the lower torso area between the waist and crotch;

said front portion, rear portion and crotch portion defining a waist opening, a left leg opening and a right leg opening;

said rear portion having a right buttock opening and a left buttock opening positioned over the respective right buttock and left buttock, each of said buttock openings having an upper portion and a lower portion;

a first support disposed substantially along the lower portion of the right buttock opening and adapted to support the right buttock of the person in a raised position; and a second support disposed substantially along the lower portion of the left buttock opening and adapted to support the left buttock of the wearer in a raised position.

BRIEF DESCRIPTION OF THE DRAWINGS

The invention can be more fully understood from the following description thereof in connection with the accompanying drawings described as follows.

DESCRIPTION OF THE PREFERRED EMBODIMENT(S)

Figure 2:
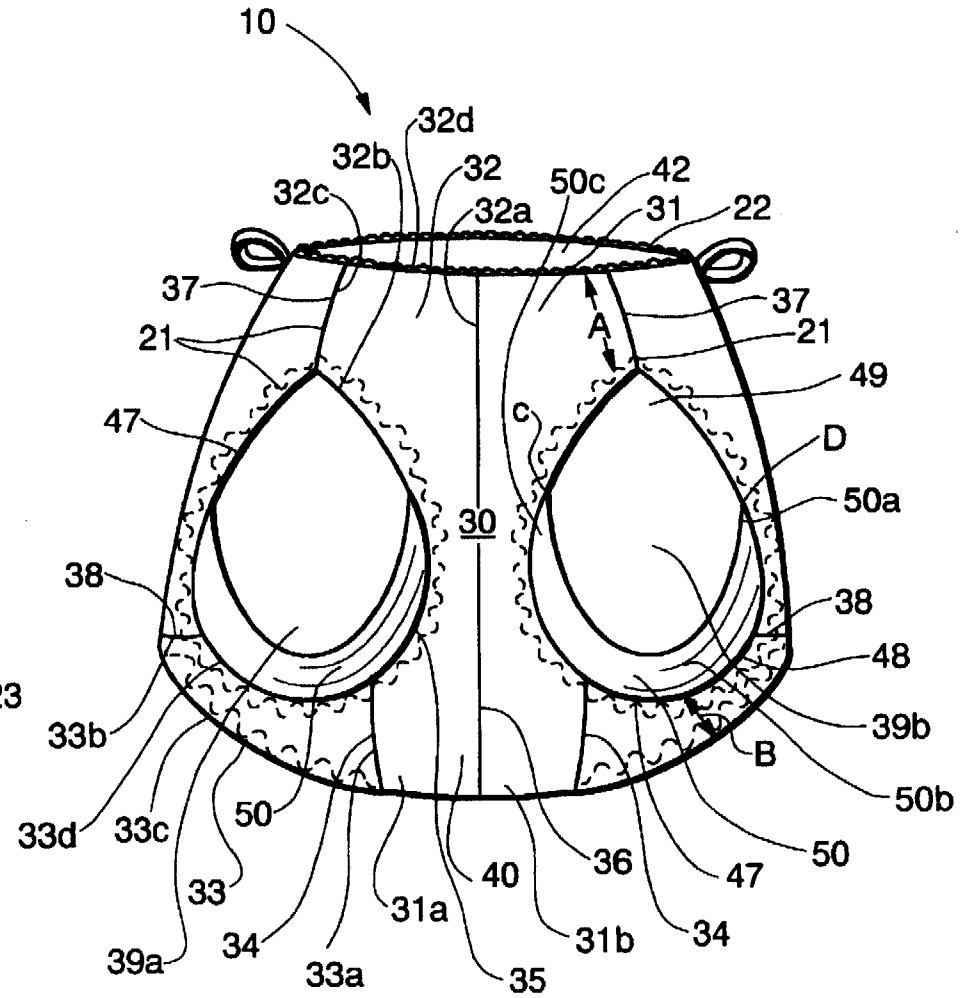
FIG. 2 is a back view of the undergarment showing a rear portion having a right buttock opening and a left buttock opening.

Throughout the following detailed description, similar reference characters refer to similar elements in all figures of the drawings.

The present invention relates to an undergarment 10 for a person which is worn on a lower torso of the person between the waist and the crotch and including hips, the derriere, and the lower abdomen. The undergarment 10 includes supports associated with openings in a back portion for supporting each buttock of the person's derriere in an uplifted position.

Figure 1:
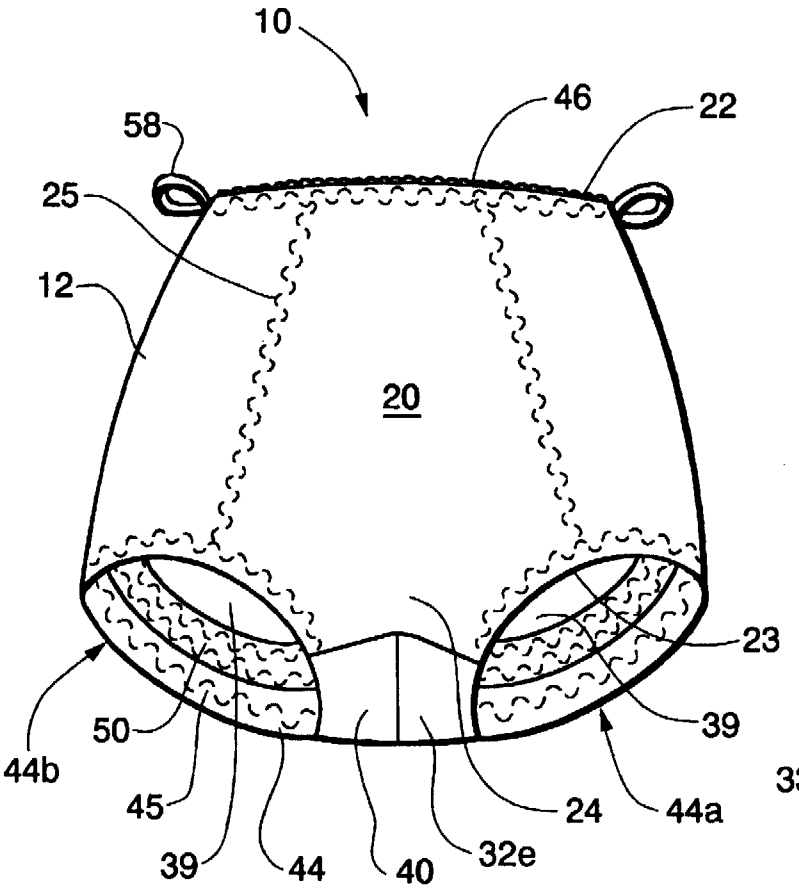
FIG. 1 is a front view of an undergarment of the present invention showing a front portion and a crotch portion.

Referring to FIGS. 1 and 2, the undergarment 10 includes a front portion 20 and a rear portion 30. The front portion 20, hereinafter may also be referred to as the front 20, includes two side edges 21, a top edge 22, a bottom edge 23 and central portion 24 opposite the top edge 22.

The rear portion 30, hereinafter may also be referred to as the rear 30, includes two panels 31, shown as a left panel 31*a* and a right panel 31*b* in FIG. 2. Each panel 31 is formed of a central part 32 and a lower part 33 and are constructed the same as follows. The central part 32 of the panel 31 has a center edge 32*a*, a curved edge 32*b* opposite the center edge 32*a*, an upper side edge 32*c*, a top edge 32*d*, and an extended portion 32*e* opposite the top edge 32*d*. The lower part 33 of the panel 31 has a central side edge 33*a*, a lower side edge 33*b*, a bottom edge 33*c*, and a curved edge 33*d* opposite the bottom edge 33*c*. The central side edge 33*a* of the lower part 33 connects by a first seam 34 to a portion of the curved edge 32*b* of the central part 32 to form the panel 31. The so-formed panel 31 thus includes a curved portion 35 extending between the upper side edge 32*c* of the central part 32 and the lower side edge 33*b* of the lower part 33 and formed by the curved edges 32*b*, 33*d* of the central and lower parts 32, 33. The left panel 31*a* and the right panel 31*b* are connected by a seam 36 at their center edges 32*a*.

The front portion 20 is connected to the back portion 30 forming the body 12 of the undergarment 10. The upper side edge 32*c* of the left panel 31*a* is connected by a second seam 37 to the first side edge 21 of the front 20 substantially near the top edge 22 of the front 20. The lower side edge 33*b* of the left panel 31*a* is connected by a third seam 38 to the first side edge 21 of the front 20 substantially near the bottom edge 23 of the front 20. Similarly, upper side edge 32*c* and the lower side edge 33*b* of the right panel 31*b* are connected to the second side edge 21 of the front 20 by second and third seams 37, 38. Preferably, the extended portion 32*e* of the panel 31 of the rear 30 is fastened by stitching to the central portion 24 of the front 20 to form a crotch portion 40.

The front portion 20 thus connected to the rear portion 30 provides the undergarment 10 with a waist opening 42 at the top edges 22, 32*d*, and two leg openings 44 which include a left leg opening 44*a*, and a right leg opening 44*b*, and encloses the hips, tummy, waist, buttocks, and crotch of the wearer. The front 20 extends from the crotch to the waist and preferably wraps about the left and right hips of the wearer. The front portion 20 may also have additional stitching 25 or layers of fabric stitched to itself as seen in FIG. 1 to offer better control of the tummy for the wearer. The crotch portion 40 extends between the left leg opening 44*a* and the right leg opening 44*b*. Each leg of the wearer fits through and extends from the leg openings 44 (as can be seen in FIG. 3).

A stretchable tape, such as elastic, may be secured to the undergarment 10 on a perimeter 45 of each leg opening 44*a*, 44*b*, and/or on a perimeter 46 of the waist opening 42 to allow for a snug fit over each leg and the waist of the wearer and to adapt the undergarment 10 to variations in body figures.

Figure 3:
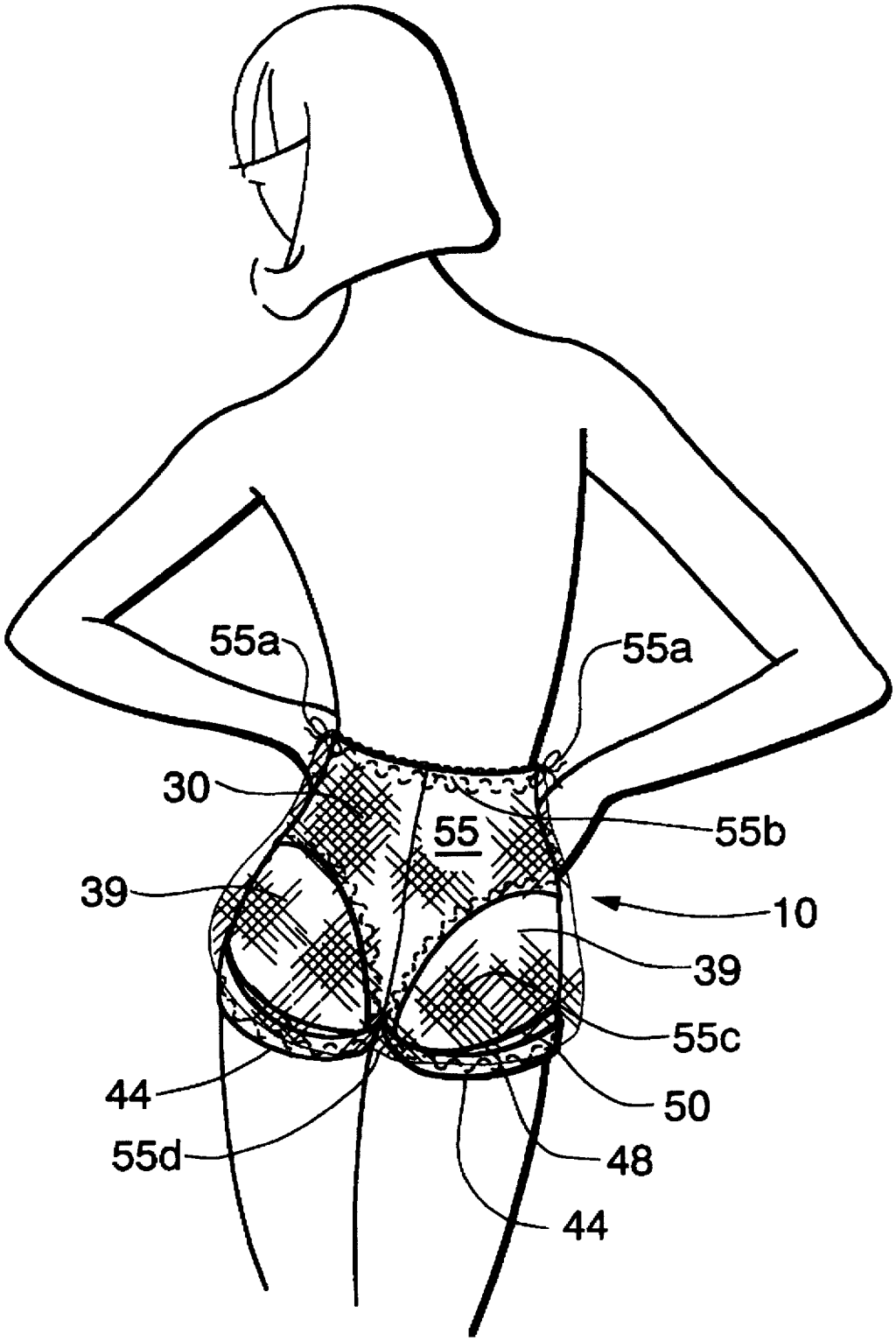
FIG. 3 is a back view of a person wearing the undergarment showing each buttock in position and being supported in the respective buttock openings by supports, and showing the undergarment and the person's buttocks covered by a shear cover.

Referring to FIGS. 2 and 3, the rear portion 30 also includes two buttock openings 39, such that a left buttock opening 39*a* is associated with the left panel 31*a* and a right buttock opening 39*b* is associated with the right panel 31*b*. The buttock openings 39 are created in the undergarment 10 by the second and third seams 37 mating the rear 30 to the front 20. Each buttock opening 39 has a perimeter 47 which is formed by the side edge 21 of the front 20 and the curved portion 35 of the panel 31. The perimeter 47 of each buttock opening 39 can be reinforced by stitching. The buttock openings 39 are sized such that each buttock (or a substantial portion of each buttock) of the wearer fits through its respective opening and is exposed. It is preferred that the openings 39 are tear-drop shaped, although any shape, including circular or elliptical, which allows the buttocks to comfortably and naturally fit through the openings is suitable. It is also preferred that both openings 39 are the same size and shape and are symmetrically positioned in the rear portion 30 of the undergarment 10.

Since the undergarment 10 can be made in different sizes to accommodate fitting of different figures and sizes of persons, the buttock openings 39 are generally proportionately sized to correspond to the size of the body 12 of the undergarment 10. The buttock openings 39 can also be sized according to the particular figure shape of the wearer. The buttock opening 39 can be positioned in any suitable location on the rear portion 30 which provides desired fit and natural appearance to the wearer. Accordingly, as seen in FIG. 2, each buttock opening 39 has a lower portion 48 and an upper portion 49. A distance A from the waist opening 42 to the upper portion 49 of buttock opening 39 and a distance B from the lower portion 48 of each buttock opening 39 to the corresponding leg opening 44 can be lengthened or shortened to accommodate the comfort and particular figure shape of the wearer. The distances A and B may change by moving the location that the waist opening 42 or the leg openings 44, fall on the lower torso of the wearer, or by changing the size and/or the shape of the buttock opening 39.

Materials suitable for use as the undergarment 10 of this invention are any which can be used in girdle-like garments including natural fabrics and synthetic fabrics such as, cotton, silk, polyester, and Nylon®. Preferably, the undergarment 10 is constructed of elastic fabrics which are capable of being stretched or expanded and can resume its former shape and size, such as for example, Lycra®, and Spandex®. Also each portion 20, 30, 40 of the undergarment 10 can be made from different materials or combinations of materials to suit the desires of the wearer.

Referring to FIGS. 2 and 3, disposed substantially along the lower portion 48 of each buttock opening 39 is a support 50. Each support 50 extends along the perimeter 47 of the lower portion 48 of the buttock opening 39 and is adapted to support the respective buttock of the wearer in a raised position. The support 50, which is attached to the perimeter 47 of the buttock opening 39 by stitching, extends along the perimeter 47 of opening 39 from position C to position D. Positions C and D are generally disposed such that the support 50 spans at least half of the perimeter 47 of the lower portion 48 of the buttock opening 39. The first seam 34 and third seam 38 provide additional stability to the support 50 and prevent the support 50 from collapsing under the buttock.

The support 50 has a first end 50*a*, a central portion 50*b*, and a second end 50*c*. Preferably the support 50 is generally crescent-shaped, that is, the central portion 50*b* of the support 50 is the widest part of the support 50 which gradually narrows down to the first and second ends 50*a*, 50*c*. The narrowed first and second ends 50*a*, 50*c* thereby are tapered to the perimeter 47 of the buttock opening 39 at positions C and D providing a smooth appearance to the buttocks at the openings 39. The wide central portion 50*b* provides maximum support at a bottom of the lower portion 48 for raising the buttocks into position. The support 50 can have the same width throughout as well as can be any elongated shape to support the buttocks without deterring from the natural shape of the upraised buttock.

In a preferred embodiment, the support 50 is made of the same material as the rest of the undergarment 10, however, the support 50 is formed from two or more layers of the fabric in order to be capable of supporting the buttocks in the upraised position without collapsing. The two or more layers may be stitched together to further reinforce the support.

Any materials having sufficient rigidity, but enough flexibility to keep the derriere looking natural, to comfortably support a person's buttocks in an upraised position are suitable. Preferably, the support is made of the same material that the rest of the undergarment 10 is made from, only it is layered. Preferably, the support 50 is four layers of the same material used for the rest of the undergarment 10, although the number of layers of material used in the support 50 will depend on the rigidity of the material itself.

Referring to FIG. 3, the undergarment 10 can include an additional feature of a cover 55 overlaying the rear portion 30 of the undergarment 10. The cover 55 provides a modest way for a person to wear the undergarment 10 of this invention by protecting the buttocks from exposure. In a preferred embodiment the cover 55 is removable from the undergarment 10. The cover 55 is generally triangular-shaped having tie ends 55*a*, waste portion 55*b*, an overlay portion 55*c*, and a crotch portion 55*d*. The undergarment 10 includes loops 58 (shown in FIGS. 1 and 2) at the perimeter 46 of the waist opening 42 in which the tie ends 55*a* are threaded through to attach the cover 55 to the undergarment 10. The tie ends 55*a* are knotted together in the front (not shown) of the wearer securing the cover 55 about the waist of the wearer. The waist portion 55*b* fits about the waist opening 42 of the undergarment 10. The overlay portion 55*c* may have gathers in the fabric so that the overlay portion 55*c* conforms to the shape of the buttocks when in the upraised position in the undergarment 10. The overlay portion 55*c* drapes from the waist portion 55*b* loosely covering the buttock openings 39 and the buttocks of the wearer. The crotch portion 55*d* of the cover 55 can be removably fastened to the crotch portion 40 of the undergarment 10 by snaps, hooks or hook-and-loop tape.

Alternatively the cover 55 can be permanently attached, by stitching for example, to the undergarment 10 at the waist opening 42 of the rear portion 30, at the crotch portion 40, and the front portion 20 along the hips of the wearer providing that the overlay portion 55*c* drapes over the buttock openings 39 of the undergarment 10. The cover 50 is preferably made of lace material, although any other light-weight, conformable fabric is suitable.

Figure 4:
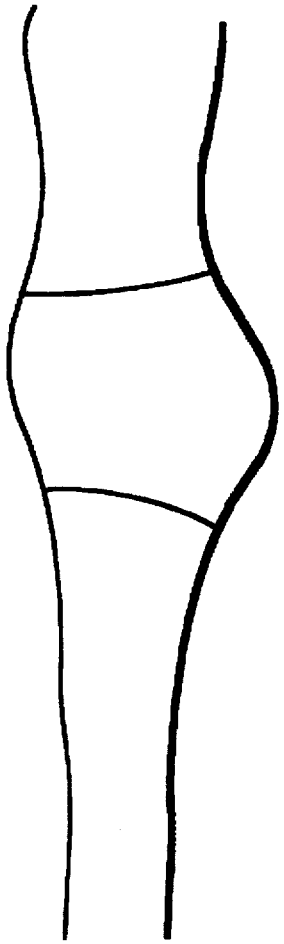
FIG. 4 is a side view of a person not wearing the undergarment of this invention showing the natural shape of the buttocks.
Figure 5:
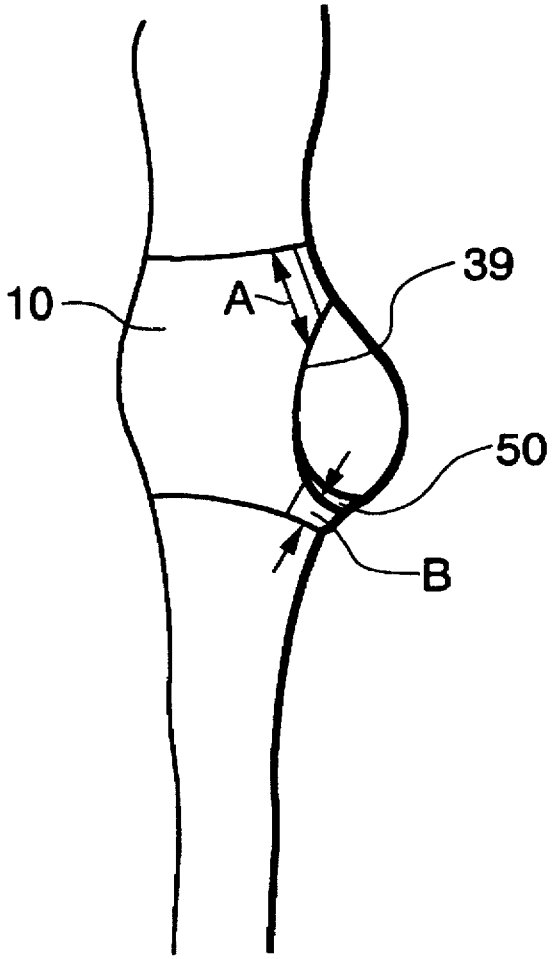
FIG. 5 is a side view of a person, who can be the person represented in FIG. 4, wearing the undergarment of this invention showing the buttocks being supported in an upraised position.

Referring to FIG. 4, a person is shown with a derriere which is in need of enhancement for an attractive appearance of the person's figure and/or to fit attractively in clothing garments. The undergarment 10 is placed on the person's lower torso area like any girdle-like undergarment. It should be noted that the undergarment 10 may also be considered similar to a thong-type undergarment. Referring to FIG. 5, once the undergarment 10 is in position, each buttock should be exposed and extend through the respective buttock opening 39 such that each buttock rests on the support 50. Thereby the buttocks of the person's derriere will be held in an upraised position by the support 55 and will appear natural when a clothing garment is worn over the undergarment 10.

Those skilled in the art having the benefit of the teachings of the present invention as hereinabove set forth, can effect numerous modifications thereto. These modifications are to be construed as being encompassed within the scope of the present invention as set forth in the appended claims.

I claim:

1. An undergarment for a person to be worn over a lower torso area including waist, crotch, hips, left buttock, and right buttock of the person, comprising:

a front portion, a rear portion and a crotch portion substantially enclosing the lower torso area between the waist and crotch;

said front portion, rear portion and crotch portion defining a waist opening, a left leg opening and a right leg opening;

said rear portion having a right buttock opening and a left buttock opening positioned over the respective right buttock and left buttock, each of said buttock openings having an upper portion and a lower portion;

a first support, having a first end, a central portion and a second end, disposed substantially along the lower portion of the right buttock opening and having sufficient rigidity to support the right buttock of the person in an upraised position; and a second support, having a first end, a central portion and a second end, disposed substantially along the lower portion of the left buttock opening and having sufficient rigidity to support the left buttock of the wearer in an upraised position.

2. The undergarment of claim 1 wherein the first end, the central portion, and the second end each have a width which is the same.

3. An undergarment for a person to be worn over a lower torso area including waist, crotch, hips, left buttock, and right buttock of the person, comprising:

a front portion, a rear portion and a crotch portion substantially enclosing the lower torso area between the waist and crotch;

said front portion, rear portion and crotch portion defining a waist opening, a left leg opening and a right leg opening;

said rear portion having a right buttock opening and a left buttock opening positioned over the respective right buttock and left buttock, each of said buttock openings having an upper portion and a lower portion;

a first support, having a first end, a central portion and a second end, disposed substantially along the lower portion of the right buttock opening and adapted to support the right buttock of the person in a raised position; and a second support, having a first end, a central portion and a second end, disposed substantially along the lower portion of the left buttock opening and adapted to support the left buttock of the wearer in a raised position, wherein the width of the first and second ends of each of the first and second supports is narrower than the width of the central portion of each of the first and second supports.

4. The undergarment of claim 3 wherein the first and second supports are crescent-shaped.

5. The undergarment of claim 3 wherein the right and left buttocks openings have the same size and shape.

6. The undergarment of claim 5 wherein the shape of each of the right and left buttock openings is tear-drop shaped.

7. The undergarment of claim 3 further comprising a cover removably attached to the undergarment and adapted to drape over the rear portion of the undergarment.

8. The undergarment of claim 7 wherein the undergarment further comprises at least one loop substantially at the waist opening for attaching the cover to the undergarment.

9. The undergarment of claim 8 wherein the cover is lace.

* * * * *